US006494595B1

(12) United States Patent
Lin

(10) Patent No.: US 6,494,595 B1
(45) Date of Patent: Dec. 17, 2002

(54) ROTARY PATTERNED LAMP

(76) Inventor: Fong-Shi Lin, 2F-1, No. 152, Nan Yar Street, Hsinchu (TW)

( * ) Notice: Subject to any disclaimer, the term of this patent is extended or adjusted under 35 U.S.C. 154(b) by 0 days.

(21) Appl. No.: 09/887,351

(22) Filed: Jun. 25, 2001

(51) Int. Cl.[7] ..... F21V 21/32

(52) U.S. Cl. ..... 362/250; 362/35; 362/286; 362/287; 362/500

(58) Field of Search ..... 362/35, 96, 286, 362/287, 500

(56) References Cited

U.S. PATENT DOCUMENTS 6,089,725 A * 7/2000 Chen ..... 362/149

* cited by examiner

*Primary Examiner*—Sandra O'Shea
*Assistant Examiner*—Guiyoung Lee
(74) *Attorney, Agent, or Firm*—Rosenberg, Klein & Lee

(57) ABSTRACT

This invention relates to a rotary patterned lamp, which includes a supporting frame to connect with a rotator. The rotator has a downward link to connect with a patterned lamp having lighting string thereon. The frame is provided with two pins, each of which is contacted with a conductive ring around the rotator and a conductive rod between the frame and the rotator. The two pins are connected with the electrical wire extendedly to the power source to provide the power to light up the bulb of the patterned lamp that obtains a rotary decorative improved lighting effect.

3 Claims, 1 Drawing Sheet

ROTARY PATTERNED LAMP

BACKGROUND OF INVENTION

Figure 1:
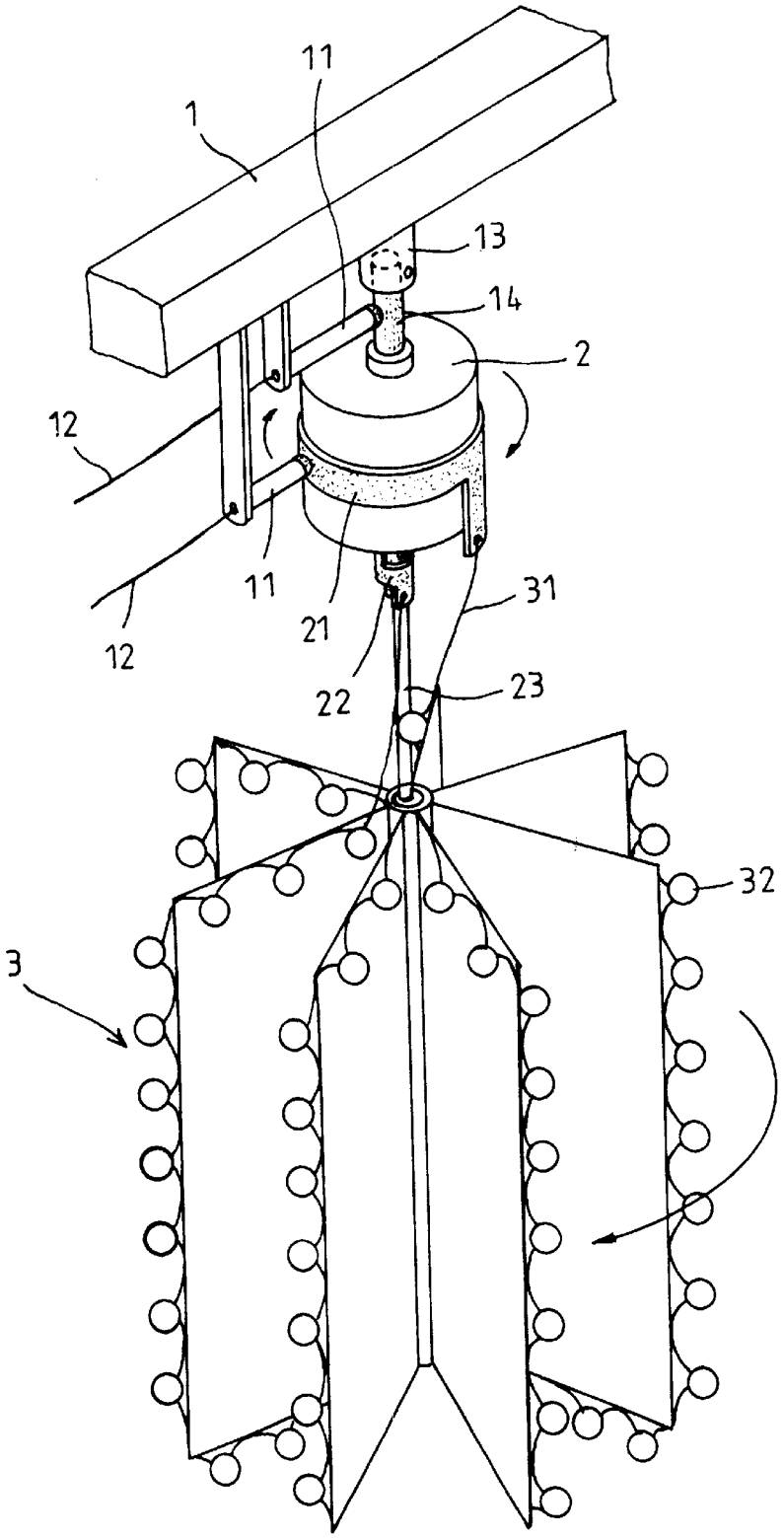

A prior patterned lamp is usually a fixed decorative structure for being hanged on a supporter or on wall to display a simple unchanged outlook. The only decorative effect is the twinkling of the bulb. It is without utility.

Accordingly, the primary object of the invention is to provide a rotary patterned lamp, which can be rotated to obtain a various decoration while the electrical wire of the patterned lamp will not be winded in disturbance and the electrical conductive connection will be maintained always for the bulb lighting. Now the features and advantages of the invention will be described in detail with reference to the accompanying drawings.

BRIEF DESCRIPTION OF THE INVENTION

FIG. 1 is a schematic perspective view showing a rotary patterned lamp according to the present invention.

DETAILED DESCRIPTION OF THE INVENTION

Please refer to FIG. 1, the present invention includes a supporting frame (1) as a main body, which is provided with two lower separated pins (11), each of which is extendedly connected with electrical wire (12) to the power source. A fixed receiver (13) formed under the frame (1) connects with a downward conductive rod (14) to connect with a rotator (2). The rotator (2) has an outer conductive ring (21) and connects with a downward link (23) and a lower conductive slice (22). The two pins (11) are respectively contacting with the conductive rod (14) and the conductive ring (21). Two ends of the electrical wire (31) of a lighting string mounted on the patterned lamp (3) are respectively connected with the conductive ring (21) and the conductive slice (22) being conductively connected with the conductive rod (14).

When the power source is on, the pins (11), the ring (21), the rod (14), and the slice (22) together with the electrical wire (31) are becoming an electrical circuit that provides the bulb (32) on the lamp (3) to light up. While the patterned lamp (3) is lightened, the rotator (2) can be rotated by an inner motor to rotate the lamp (3) at the same time that obtains a rotative decorative effect. Meanwhile, the electrical wire (31) of the patterned lamp (3) will not be winded because of the rotary conductive contact between the pin (11) and the ring (21) and rod (14). The patterned lamp (3) is capable of being rotatory by natural wind when the rotator (2) is free to be rotated while the bulb of the lamp still keeps lightened.

Accordingly, the present invention provides a new assembled structure. It uses a rotary foundation to connect with any kind of patterned lamp, which can be rotated with a various decoration, and keeps the electrical wires without being winded while the bulb being lightened. Evidently it meets the requirements of granting a patent. We hereby file an application for a patent grant.

What is claimed is:

1. A rotary patterned lamp, comprising:

a supporting frame, a fixed receiver secured to said supporting frame, a conductive rod rotatively received in said fixed receiver, a rotator coupled to said fixed receiver through said conductive rod attached to said rotator at one end thereof, an outer conductive ring embracing externally said rotator and rotating in contiguous contact therewith, a lower conductive slice attached to said rotator at another end thereof, said lower conductive slice being electrically coupled to said conductive rod, a first and a second lower separated pins secured to said supporting frame, a pair of first electrical wires supplying power to said rotary patterned lamp, each of said first electrical wires being coupled to a first end of a respective one of said first and second lower separated pins, second ends of said first and second lower separated pins being slidably connected to said conductive rod and said outer conductive ring, respectively, in electrical contact therewith, and a patterned lamp secured to said lower conductive slice through a downward link extending therebetween, said patterned lamp including a lighting string having a plurality of light bulbs and a second electric wire electrically connecting said light bulbs, said second electric wire having a pair of ends thereof, one of said ends of said second electric wire being coupled to said lower conductive slice, and another of said ends of said second electric wire being coupled to said outer conductive ring.

2. The rotary patterned lamp as claimed in claim 1, wherein said downward link includes means for connection to the patterned lamp with lighting string.

3. The rotary patterned lamp as claimed in claim 1, wherein the rotation of said rotator is independent of rotation of said patterned lamp, and wherein the disturbance of the second electrical wire is avoided.

* * * * *